US005160804A

United States Patent [19]

Wähner et al.

[11] Patent Number: 5,160,804

[45] Date of Patent: Nov. 3, 1992

[54] FIN-STABILIZED PROJECTILE

[75] Inventors: Gero Wähner, Schramberg; Dieter Girke, Troisdorf, both of Fed. Rep. of Germany

[73] Assignees: Mauser-Werke Oberndorf GmbH, Oberndorf; Dynamit Nobel AG, Troisdorf, both of Fed. Rep. of Germany

[21] Appl. No.: 723,808

[22] Filed: Jul. 1, 1991

[30] Foreign Application Priority Data

Jun. 29, 1990 [DE] Fed. Rep. of Germany ..... 4020691

[51] Int. Cl.[5] ..... F42B 5/00

[52] U.S. Cl. ..... 102/443; 102/439

[58] Field of Search ..... 102/430, 433, 434, 435, 102/439, 443, 521, 523, 703

[56] References Cited

U.S. PATENT DOCUMENTS

| | | | |
|---|---|---|---|
| H18 | 2/1986 | Bracuti et al. | 102/435 |
| 3,648,616 | 3/1972 | Hsu | 102/443 |
| 3,981,246 | 9/1976 | Luther et al. | 102/430 |
| 4,671,179 | 6/1987 | Synofzik et al. | 102/430 |
| 4,823,699 | 4/1989 | Farinacci | 102/443 |

FOREIGN PATENT DOCUMENTS

| | | | |
|---|---|---|---|
| 742908 | 9/1966 | Canada | 102/435 |
| 2323244 | 4/1979 | Fed. Rep. of Germany . | |
| 3021914 | 9/1983 | Fed. Rep. of Germany | 102/521 |
| 3205152 | 4/1984 | Fed. Rep. of Germany . | |
| 3428712 | 2/1986 | Fed. Rep. of Germany | 102/521 |
| 3517125 | 11/1986 | Fed. Rep. of Germany . | |
| 3840875A1 | 12/1988 | Fed. Rep. of Germany . | |
| 2622687A1 | 10/1987 | France . | |

*Primary Examiner*—Harold J. Tudor

*Attorney, Agent, or Firm*—McGlew and Tuttle

[57] ABSTRACT

The present invention pertains to fin-stabilized projectile ammunition, in which fin-stabilized projectiles are arranged in a cartridge case filled with propellant charge powder. According to the present invention, the spaces between the fins of the tail plane (4) of the fin-stabilized projectile (13) are filled with prefabricated shaped bodies (7) made from propellant charge powders. These shaped bodies in the ammunition are adjacent to the propellant charge powder in the cartridge case, and permit optimal utilization of the free space between the tail plane fins (20) of the projectiles being filled with high-energy propellant charge. Furthermore, the shaped bodies according to the present invention prevent corrosion of the tail plane fins during the burning off of the ammunition, and facilitate the manufacture of the ammunition.

14 Claims, 3 Drawing Sheets

FIN-STABILIZED PROJECTILE

FIELD OF THE INVENTION

The present invention pertains to ammunition with a cartridge case containing a powdered propellant charge, into which a fin-stabilized projectile, whose shell body is partially or fully surrounded by a sabot in an annular pattern, extends with its tail plane arranged in the rear.

BACKGROUND OF THE INVENTION

A subcaliber projectile, which has a tail plane provided with fins in the rear, has been known from DE No. 35,17,125 A1. According to FIG. 2 of said document, this tail plane is inserted into the propellant cartridge case filled with powdered propellant. To increase the terminal ballistic performance, such prior-art shells are made of tungsten and are made as long as possible. The maximum length of the subcaliber projectile is limited because of the cartridge length of the barrel weapons used. This makes it necessary to insert the tail plane into the propellant charge cartridge case; as a result, only a reduced amount of a powdered propellant charge can be introduced into the cartridge case, so that such an ammunition has insufficient propellant charge energy.

A fin-stabilized subcaliber projectile has been known from DE No. 23,23,244 C3. This prior-art projectile has at its tail end a tail plane, which extends into the inside of a cartridge case.

The free rear of the tail plane rests on a cartridge cover, which separates the granular propellant charge from a tubular powder following it.

To utilize the space around the tail plane for internal ballistic purposes, a powdered propellant charge is filled according to the state of the art into the propellant charge cartridge, after which the projectile with the tail plane is cautiously twirled into the powdered propellant charge until the sabot arranged above the tail plane adjoins the mouth of the cartridge case. The cartridge is subsequently rotated through 180° around the transverse axis, so that the powdered propellant charge can drop into the cavities between the fins of the tail plane, after which the arrow-tailed cartridge case base can be cautiously pressed in completely. Thus, a certain combustion chamber volume, which cannot be utilized for internal ballistic purposes, is always left, in addition to the fact that the combustion chamber volume is already reduced by the tail of the fin-stabilized projectile compared to the case of a conventional cartridge ammunition. In addition, as is shown from the above description, introduction is technically complicated.

Another disadvantage of the above-described fin-stabilized ammunition is that during the burning off of the powdered propellant charge, particles of the powdered propellant charge that have not yet burned off are thrown against the fins of the tail plane, attacking the fins mechanically, corroding or bending them.

To fire on armored targets, especially in the case of rocket warheads, cartridge type fin-stabilized sabot ammunition has been increasingly used.

In the case of this ammunition, the high requirements imposed on muzzle velocity are very often inversely proportional to the combustion chamber left in the propellant charge cartridge case after the tail of the fin-stabilized projectile with tail plane has been inserted.

SUMMARY AND OBJECTS OF THE INVENTION

Based on the above-described state of the art, it is therefore an object of the present invention to provide a cartridge type ammunition with fin-stabilized projectile of the class described in the introduction, in which the combustion chamber volume in the propellant cartridge case can be utilized nearly completely for internal ballistic purposes with simple introduction, and during the burning off of which the tail plane of the shell is protected.

According to the invention, ammunition with a cartridge case is provided containing a powdered propellant charge into which a fin-stabilized subcaliber projectile extends with its tail-side tail plane. The projectile body is partially or fully surrounded by a sabot in an annular pattern. The free space between and adjacent to the tail plane fins is filled at least partially with shaped bodies formed from material that can be burned in an exothermic process. The shaped bodies are adjoined by the propellant charge consisting of loose and/or compacted propellant charge powder bodies. The shaped bodies may be provided as individual segments which are connected to the tail plane and/or the projectile body and/or the sabot.

Variants as well as further characteristics and advantages of the invention will become apparent from the claims and, also taking into account the presentation in the abstract, from the following explanations and the description of the embodiments represented in the drawings.

According to the present invention, the shaped bodies are introduced into the free space between the fins before the fin-stabilized projectile together with the sabot is introduced into the cartridge case. Depending on the method selected for passing through, the shaped bodies are either attached, pushed over, bonded in, or fastened to the tail of the projectile in another manner. The shaped bodies are able to partially or completely fill the free space, which is delimited axially by the sabot and the bulk or pressed powder surface, on one hand, and radially by the shaft of the fin-stabilized projectile and the cylindrical shape or its jacket surface made in the diameter of the mouth of the cartridge case, on the other hand, and also the space behind the tail-side end of the tail plane when the powdered propellant charge in the cartridge case does not directly adjoin the tail end of the tail plane.

With the characteristics according to the present invention, high-energy shaped bodies are provided for a fin-stabilized projectile for filling out the space between the wall at the mouth of the propellant charge cartridge case, the fins of the tail plane, and the shaft of the tail plane, which simplify the introduction of the fin-stabilized projectile and make it possible to nearly completely utilize the combustion chamber volume in the propellant charge cartridge case for internal ballistic purposes. The high-energy shaped bodies are designed such that in conjunction with the main propellant charge, they ensure optimal internal ballistic performance with a loosely packed and/or compacted powdered propellant charge.

The high-energy shaped parts or shaped bodies according to the present invention can either be bonded between the fins of the tail plane as individual segments or be made as a whole body in one piece with a bottom plate, and be attached to the projectile tail with the tail plane. The shaped bodies are consequently arranged such that they offer mechanical protection for the tail plane against the pressure of the grains of the powdered propellant charge. Furthermore, the high-energy shaped bodies are designed such that they exert a protective effect on the surfaces of the tail plane of the fin-stabilized projectile against the hot combustion gases, so that the tail plane will no longer be damaged.

The composition of the shaped bodies is basically selected to be such that they burn off uniformly, and as a result, they make a favorable contribution to internal ballistics.

Concerning a possible powdered propellant charge, which can be used here, reference is made to the explanations in DE No. 32,05,152 C2, in which a propellant charge for cartridge type ammunition is described.

The present invention will be described below on the basis of examples shown in the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
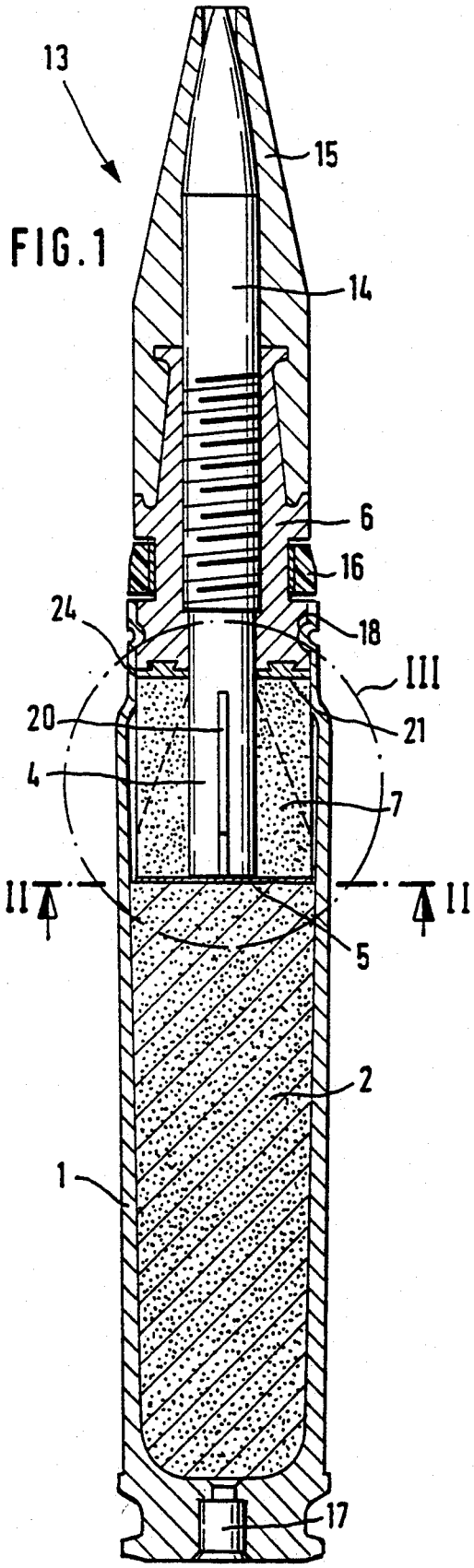
FIG. 1 is a longitudinal sectional view of a cartridge with a fin-stabilized sabot type projectile.

The fin-stabilized sabot type projectile 13 according to FIG. 1 consists essentially of the elongated projectile body 14 with the tail plane 4 arranged at the tail end.

The tip of the shell projectile is surrounded by a hood 15, which is adjoined, in the middle part of said projectile body 14, by the sabot 6 with the guide strip 16 inserted. The sabot type projectile is made into a complete cartridge with the propellant charge cartridge 1 and a detonating cap 17. The cartridge 1 is held in an annular groove 18 on the outer jacket of said sabot 6.

The main propellant charge 2, consisting of powdered propellant charge, is located in said propellant charge cartridge 1. The powder is either filled loosely into the propellant charge cartridge or is compacted in the manner described in DE No. 32,05,152 C2. A combination of loosely filled grains of propellant charge powder with compacted grains of propellant charge powder is, of course, also possible. A compacted propellant charge may be designed as a propellant charge that is uniform over the entire volume or as a gradually changing propellant charge. In the direction of said projectile body 14 of the sabot type projectile 13, said main propellant charge 2 ends at the free tail face end 5 of said tail plane 4.

Figure 2:
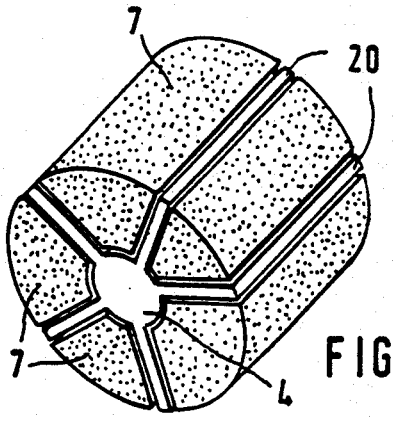
FIG. 2 is a perspective view of the free front end of the tail plane according to the section along line II—II in FIG. 1.

According to the designs shown in FIGS. 1 and 2, the free space between the fins 20 of the tail plane is filled with shaped bodies 7, which are designed as individual segments 7.

Such individual segments 7, are bodies shaped from material having a high energy density and are manufactured in separate processes. The individual segments are fastened to the tail plane, e.g., by bonding in or inserting or other manner of connecting. The length of the shaped bodies 7 extends from the free rear end 5 of said tail plane 4 to the bottom 21 of the sabot. The external diameter of said shaped bodies 7 introduced is somewhat smaller than the internal diameter of the mouth 24 of the propellant charge cartridge case 1. For graphic reasons, a relatively large gap, which decreases, e.g., in the case of bonding connection, to the thickness of the adhesive layer, is shown in FIG. 2 between the fins 20 of the tail plane and the respective opposite surfaces of said shaped bodies 7.

To achieve simple introduction while optimally utilizing the combustion chamber available, the propellant charge cartridge case 1 is filled, according to the present invention, with loose and/or precompacted powdered propellant charge to such an extent that the arrow tail with tail plane 4 to be introduced is still freely movable with its front end 5. Then, the fin-stabilized projectile 13 with the sabot 6 and the tail plane 4, between the fins 20 of which the shaped bodies 7 manufactured according to an appropriate process are introduced and fill the space between the bottom 21 of the sabot and the tail plane end 5 nearly to the internal diameter of the cartridge type ammunition, is pressed into the propellant charge cartridge case 1. Due to this measure, the volume of the combustion chamber of the propellant charge cartridge case 1 is utilized nearly completely, and introduction itself is technically simplified. The individual shaped bodies 7 are adapted to the main propellant charge 2 such that together with it, they bring about an optimal internal ballistic performance.

Figure 3:
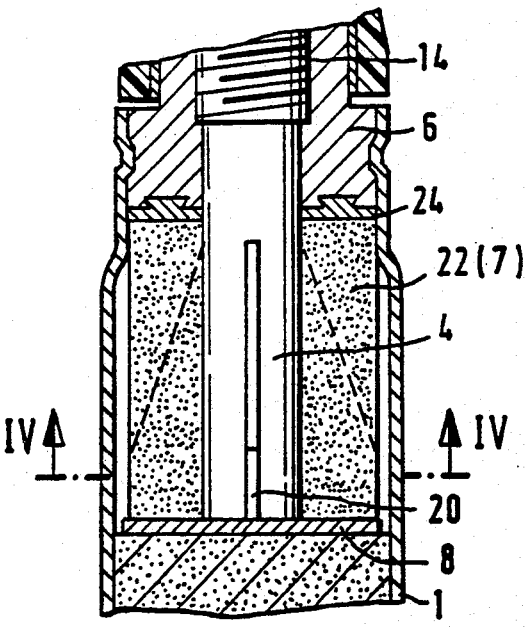
FIG. 3 is an enlarged detail of the sabot type projectile corresponding to detail III in FIG. 1 with shaped bodies of a different design.
Figure 4:
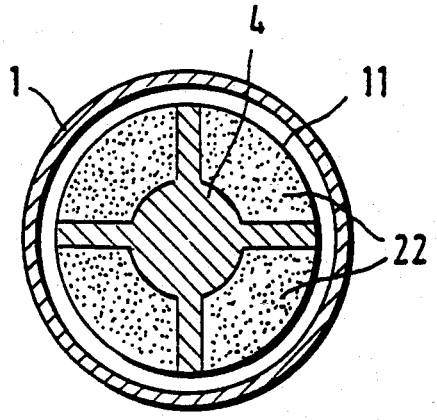
FIG. 4 is a section through the shaped body according to line IV—IV in FIG. 3.

To further simplify introduction, the shaped bodies 7 are designed according to FIGS. 3 and 4 such that together with a bottom plate 8, the individual segments 22 form a single shaped body, which is pushed over said tail plane 4 from the free end 5 of the tail plane, and is fastened.

Consequently, said segments 22 are pre-assembled on a bottom plate 8 or are preformed together with this and are pushed as a charge unit over the tail plane tail 4 of said projectile body 14.

Figure 5:
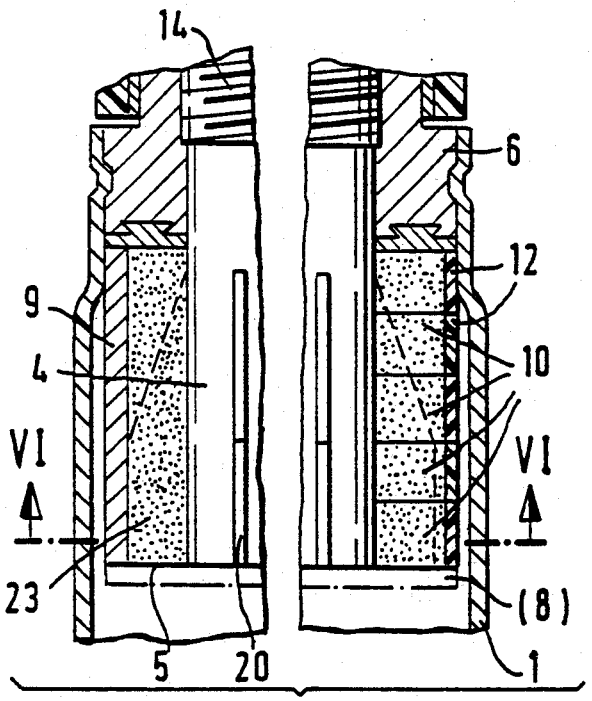
FIG. 5 is a variant to FIG. 3.
Figure 6:
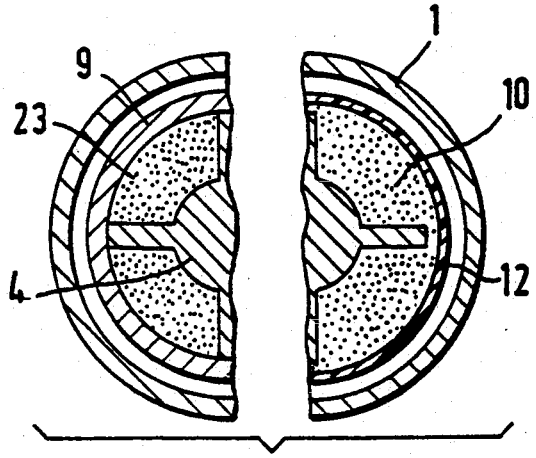
FIG. 6 is a cross sectional view taken through the shaped bodies along line VI—VI in FIG. 5.

In another embodiment of the present invention as shown in FIG. 6, shaped bodies 23 may be provided with a cylindrical outer jacket 9, from which said segments 23 are directed radially in the inward direction toward said projectile body 14. The cylindrical jacket 9 may be made in one piece with the segments 23. According to the design shown in the left-hand part of FIG. 5, the jacket 9 and said individual segments 23 are composed of separate parts. As is shown in the right-hand part of FIG. 5, said segments 23 may also be replaced with shaped bodies designed as annular disks 10, which are pushed one over the other on said tail plane 4 from the free end 5 of the tail plane. Said annular disks 10 are made either in one piece with recesses for the fin-stabilized shell and fins, or from separate components.

Figure 7:
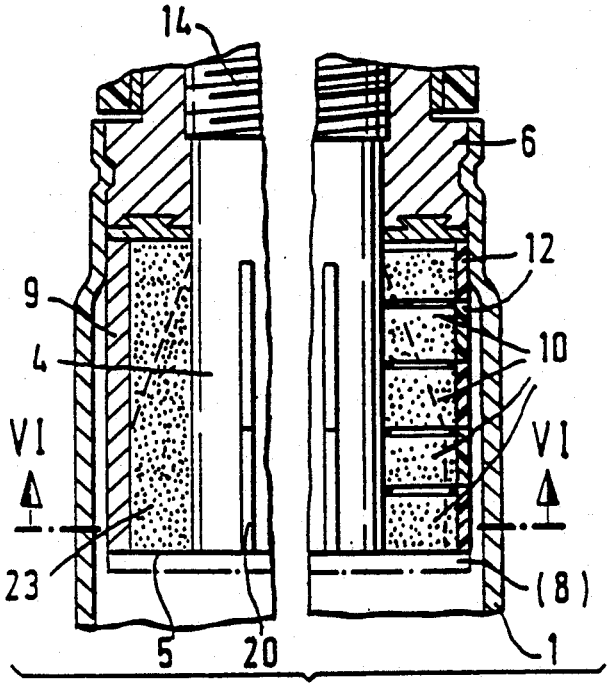
FIG. 7 is similar to FIG. 5 and shows spaces between the disks.

Said annular disks 10 may be arranged axially directly one on top of the other; it is possible to maintain the axial distances by means of spacers, e.g., knobs on the disks, which are connected to the annular disks in one piece, or with separate spacers located between them, as shown in FIG. 7.

The embodiment with one-piece annular disks is especially advantageous when sufficient clearance is available between the diameter of the tail plane and the internal diameter of the propellant charge cartridge case. In principle, these designs lead to a further substantial simplification of manufacture.

In addition, said shaped bodies 7, 9, 10, 22, 23 advantageously protect the fins of the tail plane from mechanical damage and deformations, which may occur according to the present invention due to the pressure of the grains of the powdered propellant charge during the phase of detonation, especially in the case of particularly thin tail plane fins.

The basic material for the high-energy shaped bodies may vary greatly. Thus, it is possible to use stabilized explosives and explosives mixed with a binder, or propellant charge bodies that are embedded in a foam matrix or partially dissolved or wetted with a binder, and compacted. It is also possible to make shaped bodies from nitrocellulose paper.

Another major advantage of these shaped bodies used according to the present invention is the fact that their energy content can be equal to or less than the main propellant charge 2. By appropriate chemical formulation, it is thus possible to form a cooler gas jacket around the sensitive tail plane fins 20 compared with the hotter combustion gases of said main propellant charge 2.

To further utilize this advantage, it is also possible to impregnate the material of these shaped bodies with erosion-reducing and/or muzzle fire-inhibiting substances. According to FIG. 4, such substances are applied as an outer layer 11 to a shaped body 22. However, according to the representation in FIG. 5, it is also possible to make individual annular disks 12 of a shaped body fully or partially from such substances.

While specific embodiments of the invention have been shown and described in detail to illustrate the application of the principles of the invention, it will be understood that the invention may be embodied otherwise without departing from such principles.

What is claimed is:

1. Ammunition, comprising: a cartridge case containing a powdered propellant charge; a fin-stabilized subcaliber projectile having a tail-side tail plane extending into said cartridge case, said subcaliber projectile having a projectile body which is surrounded by said cartridge case in an annular manner, said subcaliber projectile having tail plane fins defining a free space between adjacent fins; preformed shaped bodies, formed from a high energy density propellant material that can be burned in an exothermic process, each of said preformed shaped bodies having a radial cross-sectional shape which is similar to the shape of the free space and being positioned between adjacent fins at least partially filling said free space between and adjacent to said tail plane fins, said preformed shaped bodies substantially filling said free space in a radial cross-section, said preformed shaped bodies being adjoined by said powdered propellant charge, said powdered propellant charge being formed of loose and/or compacted propellant charge powder bodies.

2. Ammunition according to claim 1, wherein said performed shaped bodies are formed as individual segments which are connected to one of said tail plane, said projectile body and said sabot.

3. Ammunition according to claim 1, wherein said preformed shaped bodies are formed of individual disks, lying one on top of the other, said disks forming recesses receiving the projectile body and fins.

4. Ammunition according to claim 3, wherein said disks are spaced from one another.

5. Ammunition according to claim 1, wherein said preformed shaped bodies are formed of individual segments in one piece with a common bottom plate.

6. Ammunition according to claim 1, wherein said preformed shaped bodies are arranged between said fins and are connected by a common jacket surface, said common jacket surface having an external diameter corresponding at a maximum, to an internal diameter of a cartridge case mouth of said cartridge case.

7. Ammunition according to claim 1, wherein said preformed shaped bodies are formed as a combination of a plurality of individual shaped bodies.

8. Ammunition according to claim 1, wherein said preformed shaped bodies are formed of propellant charge powder bodies.

9. Ammunition according to claim 1, wherein said preformed shaped bodies are formed from one of, stabilized explosives mixed with a binder, propellant charge powder bodies embedded in a foam matrix, propellant charge powder partially dissolved in a binder, propellant charge wetted with a binder, pressed propellant charge powder bodies and shaped parts made from nitrocellulose paper.

10. Ammunition according to claim 1, wherein said preformed shaped bodies have one of an erosion-reducing and a muzzle fire-reducing substances as additives.

11. Ammunition according to claim 1, wherein said preformed shaped bodies are provided with an energy content which is equal to or lower than the energy content of the propellant charge powder arranged in the propellant charge cartridge case.

12. Ammunition comprising: a cartridge case containing a powdered propellant charge; a fin-stabilized subcaliber projectile having a tail-side tail plane extending into said cartridge case, said subcaliber projectile having a projectile body which is surrounded by said cartridge case in an annular manner, said subcaliber projectile having tail plane fins defining a free space between adjacent fins; individual preformed segments, formed from a high energy density propellant material that can be burned in an exothermic process, each of said individual preformed segments having a radial cross-sectional shape which is similar to the shape of the free space and positioned between adjacent tail plane fins to at least partially fill said free space between said tail plane fins and a space adjacent to said tail plane fins, said individual preformed segments substantially filling said free space in a radial cross-section, said individual preformed segments being adjoined by said powdered propellant charge, said powdered propellant charge being formed of loose and/or compacted propellant charge powder bodies.

13. Ammunition according to claim 12, wherein: said individual preformed segments are shaped in wedge-shaped segments which are connected to one of said tail plane, said projectile body and said cartridge case base.

14. Ammunition in accordance with claim 12, wherein:

said individual preformed segments are bonded to said tail plane fins, said individual preformed segments having sufficient hardness to protect said tail plane fins from damage due to physical contact.

* * * * *